US006302428B1

(12) United States Patent
Jungkind

(10) Patent No.: US 6,302,428 B1
(45) Date of Patent: Oct. 16, 2001

(54) SNOWBOARD STEP-IN BINDING

(75) Inventor: Roland Jungkind, Garmisch-Partenkirchen (DE)

(73) Assignee: Japana Co., Ltd. (JP)

( * ) Notice: Subject to any disclaimer, the term of this patent is extended or adjusted under 35 U.S.C. 154(b) by 0 days.

(21) Appl. No.: 09/445,610

(22) PCT Filed: Apr. 8, 1999

(86) PCT No.: PCT/DE99/01047

§ 371 Date: Dec. 8, 1999

§ 102(e) Date: Dec. 8, 1999

(87) PCT Pub. No.: WO99/52608

PCT Pub. Date: Oct. 21, 1999

(30) Foreign Application Priority Data

Apr. 9, 1998 (DE) ..... 298 06 599 U

(51) Int. Cl.[7] ..... A63C 9/00
(52) U.S. Cl. ..... 280/624; 280/14.22
(58) Field of Search ..... 280/14.21, 14.22, 280/624, 625, 626, 627, 623, 634, 617, 618

(56) References Cited

U.S. PATENT DOCUMENTS 4,973,073 * 11/1990 Raines et al. ..... 280/14.22
5,520,406 * 5/1996 Anderson et al. ..... 280/624
5,722,680 * 3/1998 Dodge ..... 280/624
5,871,226 2/1999 Klubitschko et al. .
5,890,730 4/1999 Anderson et al. .
5,971,422 * 10/1999 Anderson et al. ..... 280/624
5,975,557 11/1999 Snoke et al. .
6,050,589 * 4/2000 Couderc et al. ..... 280/14.21

FOREIGN PATENT DOCUMENTS 195 44 696 6/1997 (DE) .
192189 * 8/1986 (EP) ..... 280/624
2689776 * 10/1993 (FR) ..... 280/624
WO 96/05894 2/1996 (WO) .

* cited by examiner

*Primary Examiner*—Frank Vanaman
(74) *Attorney, Agent, or Firm*—D. Peter Hochberg; Katherine R. Vieyra; William H. Holt

(57) ABSTRACT

A snowboard step-in binding having a rotatable soleholder that can be moved between two limit positions and can be opened using an opening lever. In order to ensure a secure lock with the soleholder even with a layer of snow present, but prevent inadvertent opening, a dual-action lever with one arm designed as an opening lever and the other arm designed as a rotating lock is provided. This rotating lock is maintained by forcing two cam surfaces, which extend from a common apex and contain an intermediate rest surface, against a locking bolt by the force of a spring.

4 Claims, 3 Drawing Sheets

SNOWBOARD STEP-IN BINDING

BACKGROUND OF THE INVENTION

1. Field of the Invention

This invention relates to snowboard step-in bindings and, in particular, to step-in bindings having a cam mechanism to releasably lock the soleholder in a locked position.

2. Description of the Prior Art

When snowboarders have their boots locked in the bindings on a snowboard, it is important that those bindings remain in the locked position until they are voluntarily released by the snowboarder. In a step-in binding, the snowboarder inserts the sole of his or her boot into a generally rotatable soleholder and steps down to lock the soleholder in place. It should remain locked in place even if there is snow on the snowboard. It would be dangerous if a snowboard binding were to inadvertently open while the snowboard is in use, since the snowboarder could become injured. A simple yet effective device for locking a snowboarder's boot on a snowboard which cannot be released unless done so by the snowboarder would be a useful device for this sport.

SUMMARY OF THE INVENTION

It is an object of the present invention to provide a stepin binding for a snowboard which locks the snowboarder in position on the snowboard and not being releasable unless the snowboarder deliberately releases the binding.

Another object of the present invention is to provide a step-in snowboard binding having the aforementioned characteristics and which is simple in construction and efficient in use.

Yet another object of the present invention is to provide a snowboard binding which operates to lock a snowboarder's boots in the binding even if there is snow on the sole plate upon which the boot is placed.

Other objects will be apparent from the description to follow and from the appended claims.

The invention provides an improved snowboard step-in binding, having a cam mechanism for controlling the rotation of the soleholder to releasably lock the soleholder in a locked position. The binding has a rotatable soleholder which mates with a longitudinal side of the sole of the boot. The rotatable soleholder is designed in the shape of a claw, and can tilt or rotate between two limit positions. There is a stationary soleholder which is attached permanently to the sole plate for the other side of the boot. A dual-action lever is hinged at the rotatable soleholder wherein one arm of this lever serves as an opening lever to arbitrarily move the soleholder from its locked position to its released position. The other arm is designed as a rotation lock, which is held in place by a spring used to force two cam surfaces against a locking member such as a bolt, which is fastened securely to a plate. These cam surfaces extend from a common apex.

From an intermediate position, this snowboard step-in binding provides two phases of motion caused by the apex of the rotation lock for the dual-action lever. Each of these phases of motion has a limit position. The force of the spring either causes or aids the motion into the respective limit positions. On the other hand, the force of the spring opposes motion to the intermediate position.

On one hand, this snowboard step-in binding prevents inadvertent opening of the binding once the boot is inserted, but on the other hand it also secures the sole of the boot to the sole plate even with a layer of snow present. For this purpose, a securing member is provided that prevents inadvertent return of the dual-action lever back over the intermediate position after it has moved into the locked position, which is located past the intermediate position. The arrangement is designed such that when the opening lever is used, the securing member is actuated along with it, which disengages the soleholder to release the boot. A special support spring is provided for the securing member.

The purpose of the invention is to create a common snowboard step-in binding that has a simplified construction while still meeting the required safety requirements.

This is accomplished in that, with reference to the apex between the two cam surfaces, the cam surface extending away from the fulcrum of the lever has an intermediate rest saddle or surface before it meets this apex.

If there is a force generated at the boot holder tending to open it, this force results in the rotation lock moving against the force of the spring. This motion ends when the resting cradle or surface comes to rest against the locking member.

BRIEF DESCRIPTION OF THE DRAWINGS

The attached drawing describes an embodiment of the invention as follows.

DESCRIPTION OF THE PREFERRED EMBODIMENT

Figure 4:
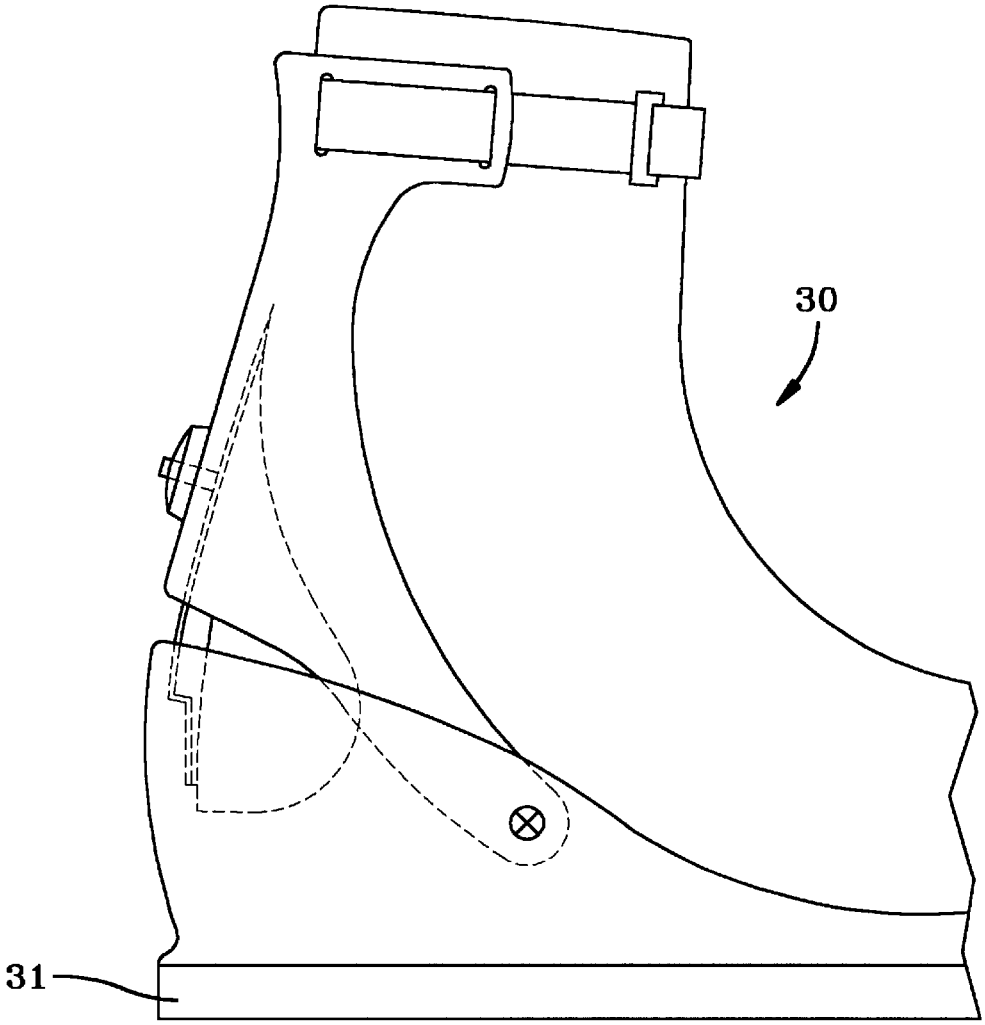
FIG. 4 is a side view of a portion of a snowboard boot with calf support.

Since the invention pertains only to the tiltable or rotatable boot holder of the common snowboard step-in binding, an overall representation of the binding is not included. The sole plate of the binding is shown schematically and identified as 1. Its lateral side plates 2 hold a soleholder 4 at a tilting axis or axis of rotation 3. This tilting axis is parallel to the direction in which the boot is inserted. The acting side of the boot holder is in the shape of a claw, forming a hold-down portion 5 and a guide 6. Portion 5 and guide 6 form a sole-receiving configuration for receiving part of the longitudinal sole of a boot 31(FIG. 4). A dual-action lever 8 is hinged at the boot holder 4 at a pivot axis 7. Axis 7 runs parallel to tilting axis 3.

The arm of lever 8 that extends out from the binding serves as an opening lever, while the other arm is designed as a rotation lock. A locking member which can be a bolt 9, also running parallel to axes 3 and 7, cooperates with the rotation lock and is mounted to the latter side plates 2. Also fastened to these side plates is a pin 10 on which a tension spring 11 is connected. At its other end, the tension spring is hung or connected on a pin 12 that is fastened to opening or dual-action lever 8.

The arm of lever 8 that is designed as a rotation lock contains two cam surfaces 13 and 14 and an apex 15 located between them. Cam surface 13 starts at this apex and approaches pivot axis 7 of lever 8, while cam surface 14 extends away from axis 7. According to the invention, cam surface 14 meets apex 15 with an intermediate resting cradle or surface 16 located between it and the apex.

Figure 1:
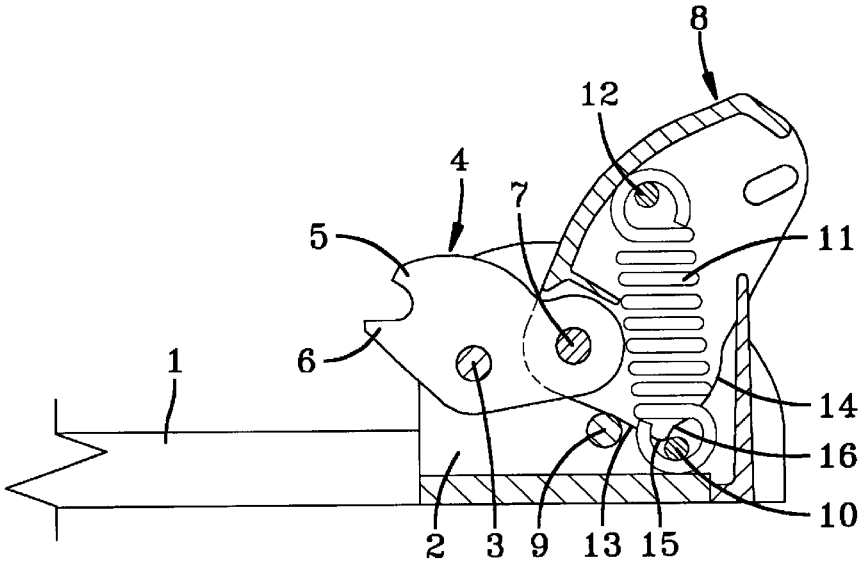
FIG. 1 is a cross section of the tiltable boot holder or soleholder (with associated parts) of the binding as seen in the direction of the boot to be inserted and in the opened or release state.
Figure 2:
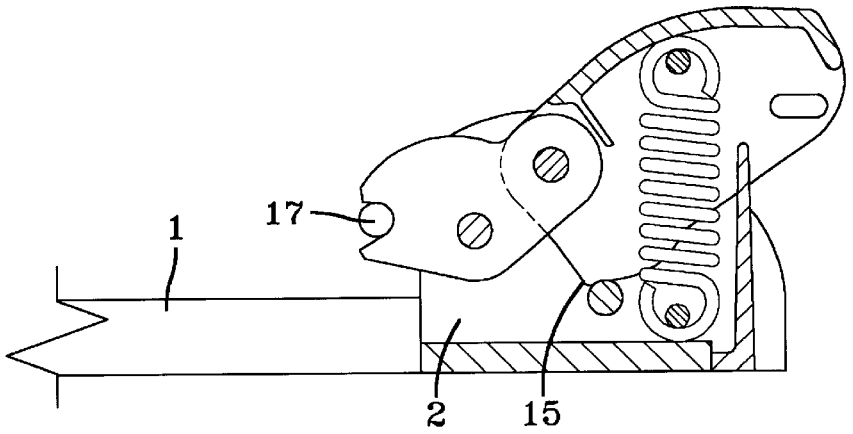
FIG. 2 is a cross section of the soleholder corresponding to FIG. 1, but in the intermediate position.
Figure 3:
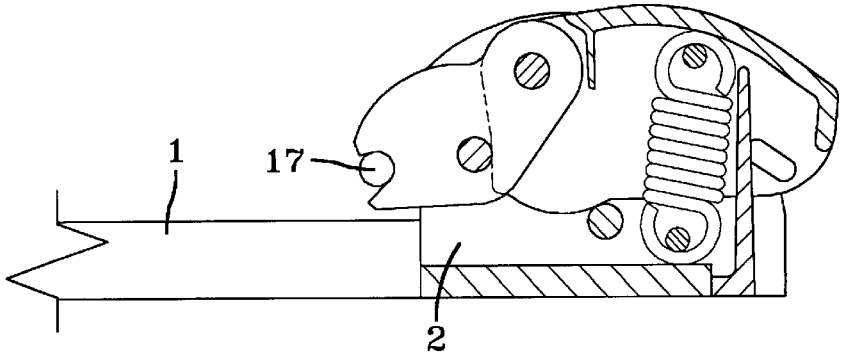
FIG. 3 is a cross section of the soleholder corresponding to FIG. 2, but in the lower limit position.

FIG. 1 shows soleholder 4 in the state ready for insertion. When a boot is inserted, the mating attachment on the sole of the boot comes into contact with guide 6. This mating attachment is shown in FIGS. 2 and 3 and is identified as 17. By stepping down, this attachment tilts the soleholder 4 to the position according to FIG. 2. In this position, cam surface 13 of the rotation lock has already passed by the locking member or bolt 9. The bolt then rests in the resting surface 16 located on the other side of the apex. In this way, soleholder 4 is blocked from opening. When the sole of the boot is pushed down further, the position according to FIG. 3 is reached in which the exterior of cam surface 14 lies against the locking bolt 9. This position is secured by the force of the spring 11.

If a force is transferred from the boot soleholder 4 and is large enough to exceed the resistance of spring 11, the soleholder can move back to the position according to FIG. 2. However, when this position is reached, the boot holder cannot tilt upward any further because of its design. This position is released only by using the opening lever to open the binding, which can be done at any time.

The invention can be used with various numbers of similar bindings having additional rotatable soleholders. It is preferred that no more than three such soleholders be incorporated in any binding.

Figure 5:
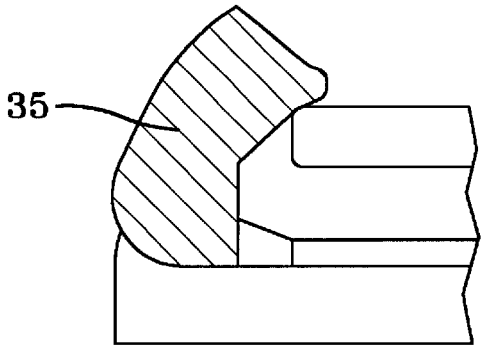
FIG. 5 is a side cross sectional view of a fixed soleholder of a snowboard binding.
Figure 6:
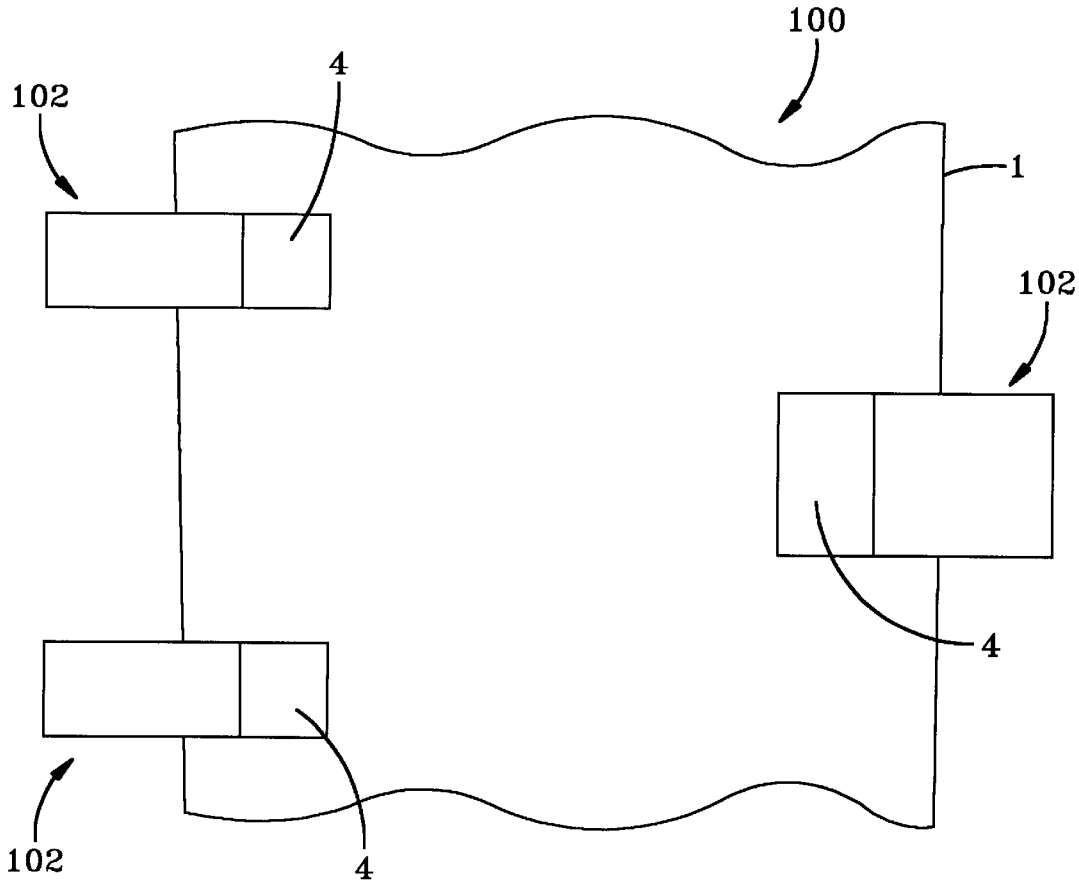
FIG. 6 is a top schematic view of a multiple soleholder embodiment of the invention.

FIG. 4 shows the snowboard boot with calf support 30 of U.S. Pat. No. 5,975,557, incorporated herein by reference, illustrating the longitudinal sides of the boot sole 31. FIG. 5 shows the snowboard binding of U.S. Pat. No. 5,871,226, incorporated herein by reference, illustrating the fixed soleholders 35. FIG. 6 is a top schematic view of a multiple soleholder embodiment 100 of the invention. The figure shows a sole plate 1. Attached to the sole plate 1 are three assemblies 102 which are the assemblies shown in FIGS. 1–3. Each assembly 102 has a soleholder 4. As noted Above, there should not be more than three soleholders per snowboard binding.

The invention has been described in detail with particular emphasis on the preferred embodiment, but variations and modifications within the spirit and scope of the invention will appear to those skilled in the art to which the invention pertains.

I claim:

1. A snowboard step-in binding for attachment to a sole plate fastenable to a snowboard, said binding comprising:

a movable soleholder mounted for rotation about a rotation axis, and having a sole-receiving configuration to receive a longitudinal part of a boot sole on one side of a snowboard boot in cooperation with a fixed soleholder for engaging another part of the boot sole on the other side of the snowboard boot, said movable soleholder being rotatable between a release position for releasing the boot sole and a locked position for locking the boot sole to the snowboard;

a dual-action lever pivotally mounted on said movable soleholder on a pivot axis, said dual-action lever having one arm for rotating said movable soleholder from the locked position to the release position, said one arm having a first cam surface, and a second arm for rotating said movable soleholder from the release position to the locked position and maintaining said movable soleholder in the locked position; said second arm having a second cam surface meeting said first cam surface at an apex, said second cam surface having a resting surface adjacent said apex and an exterior cam surface;

a locking member fixed with respect to said movable soleholder and said dual-action lever for engaging said first cam surface and said second cam surface as said lever pivots on said movable soleholder; and a spring member for biasing said dual-action lever to the locked position;

said first cam surface being engaged by said locking member between said apex and said pivot axis to hold said movable soleholder in the release position against the bias of said spring member, and said movable soleholder being rotatable in response to the stepping of the boot sole into said sole-receiving configuration of said movable soleholder to pivot the dual-action lever until said apex moves between said locking member and said pivot axis, and said resting surface being engagable by said locking member both to block said dual-action lever from pivoting and to block the rotation of said movable soleholder to the release position, and said movable soleholder being further rotatable to the locked position in response to additional stepping of the boot sole into said sole-receiving configuration, said dual-action lever being pivoted in response to rotation of said movable soleholder and being secured in place by said spring member in response to the engagement of said second cam surface by said locking member; and said dual-action lever being voluntarily pivotable to rotate said movable soleholder to the release position.

2. A snowboard step-in binding according to claim 1 and further including a first spring-holding member located on said dual-action lever and a second spring-holding member fixed relative to said dual-action lever and to said movable soleholder, and said spring member comprises a spring having one end connected to said first spring-holding member and a second end connected to said second spring-holding member.

3. A snowboard step-in binding according to claim 2 wherein said snowboard step-in binding further comprises a lateral side plate extending from the sole plate, a soleholder axle extending from said lateral side plate for holding said soleholder for rotation, said locking member being attached to said lateral side plate, and said second spring-holding member being attached to said lateral side plate.

4. A snowboard step-in binding according to claim 1 wherein when said locking member is engaged with said resting surface of said second cam surface, said pivot axis is located above said locking member and said rotation axis of said movable soleholder, and said movable soleholder being non-responsive to a boot sole held in said sole receiving configuration to rotate to the release position, and said movable soleholder rotating to the release position in response to the rotation of said dual-action lever.

* * * * *